US006087971A

United States Patent [19]

Clarke et al.

[11] Patent Number: 6,087,971

[45] Date of Patent: Jul. 11, 2000

[54] METHOD OF FABRICATING AN IMPROVED CERAMIC RADOME

[75] Inventors: David R. Clarke, Newbury Park; Frederick F. Lange, Thousand Oaks, both of Calif.

[73] Assignee: The Boeing Company, Seal Beach, Calif.

[21] Appl. No.: 06/417,278

[22] Filed: Sep. 13, 1982

[51] Int. Cl.[7] ..... H01Q 17/00

[52] U.S. Cl. ..... 342/4; 264/65

[58] Field of Search ..... 342/1, 3, 4; 264/65, 264/6 D

[56] References Cited

U.S. PATENT DOCUMENTS 4,310,499 1/1982 Mitomo ..... 264/65

4,377,542 3/1983 Mangels ..... 264/65

4,379,110 4/1983 Greskovich ..... 264/65

*Primary Examiner*—Peter A. Nelson

*Attorney, Agent, or Firm*—C. O. Malin; Charles T. Silberberg

[57] ABSTRACT

Ceramic radomes are fabricated using a method which reduces the dielectric losses of the ceramic material. A $Si_3N_4$ ceramic powder is mixed with a suitable densification aid and then sintered to form a dense ceramic having a glassy phase. Silicon dioxide is then provided on the surface of the ceramic by packing it in silicon dioxide powder or by heating it in air to oxidize its surface. The ceramic and silicon dioxide are heated at a temperature sufficient to cause diffusion of impurities and additive cations from the glassy phase into the silicon dioxide. The surface of the ceramic is then ground to remove pits and to shape the ceramic into a radome.

12 Claims, 1 Drawing Sheet

METHOD OF FABRICATING AN IMPROVED CERAMIC RADOME

BACKGROUND OF THE INVENTION

This invention relates to the field of radomes, and particularly to radomes used at high temperatures.

The surfaces of high speed missiles are subjected to aerodynamic heating and to significant mechanical stresses and erosion. Consequently, radomes for high speed missiles must have both good high temperature strength and suitable dielectric properties within the entire temperature range at which the missiles operate.

Silica ($SiO_2$) has proven useful for making high temperature radomes. However, there exists a continuing need for radome materials having greater high temperature strength and erosion resistance together with good dielectric properties.

Hot-pressed silicon nitride ($Si_3N_4$) ceramics have been developed which have excellent high temperature (over 1000° C.) strength and erosion resistance. Although pure $Si_3N_4$ has adequate dielectric constants for radomes at room temperature and at elevated temperatures, when fabricated into components by standard ceramic production methods (using sintering aids, milling media, etc.), the dielectric losses are substantially increased, particularly at high temperatures.

The millimeter wave dielectric constants of prior art (hot-pressed, or reaction bonded) $Si_3N_4$ materials are relatively high, being in the range of 7.5 to 9.5. These values imply that absolute tolerances in thicknesses need to be better than 0.001 inch in second order radomes (N=2, t~0.122 inch at 35 GHz). Additionally, they cause the power transmission and phase shift through the radome wall to be strongly dependent on the incident angle, so that matching to the antenna system cannot be readily achieved over wide angular ranges. This, in turn, introduces excessive reflective power loss as well as boresight error in a scanning radar system. Because the dielectric constant and dielectric loss change with temperature, matching wall thickness to the antenna is altered as the radome heats up under aerodynamic heating.

SUMMARY OF THE INVENTION

It is an object of the invention to provide an improved radome.

It is an object of the invention to provide a radome which has improved high temperature strength and erosion resistance.

It is an object of the invention to provide a high temperature, high strength radome which has low dielectric losses and a low temperature-dependence of the dielectric losses.

According to the invention, $Si_3N_4$ ceramic powders are mixed with densification aids and sintered in a prior art manner to form a dense $Si_3N_4$ ceramic having a glassy intergranular phase. To improve the ceramic's dielectric properties, cations are then drawn out of the glassy phase. This is accomplished by providing $SiO_2$ on the surface of the ceramic and then heating it at a temperature sufficient to cause diffusion of the cations from the glassy intergranular phase into the $SiO_2$. The $SiO_2$ is then removed from the surface and the ceramic surface is ground to remove pits which may develop during the $SiO_2$ treatment. Finally, the treated ceramic is machined to shape it into the required radome configuration.

In a preferred embodiment, the $SiO_2$ treatment comprises heating the dense $Si_3N_4$ ceramic in air to form an oxidized layer of $SiO_2$.

In another preferred embodiment, the $SiO_2$ treatment comprises packing the sintered $Si_3N_4$ ceramic in $SiO_2$ powder.

These and other objects and features of the invention will be apparent from the following detailed description taken with reference to the accompanying drawings.

DESCRIPTION OF THE PREFERRED EMBODIMENT

Figure 1:
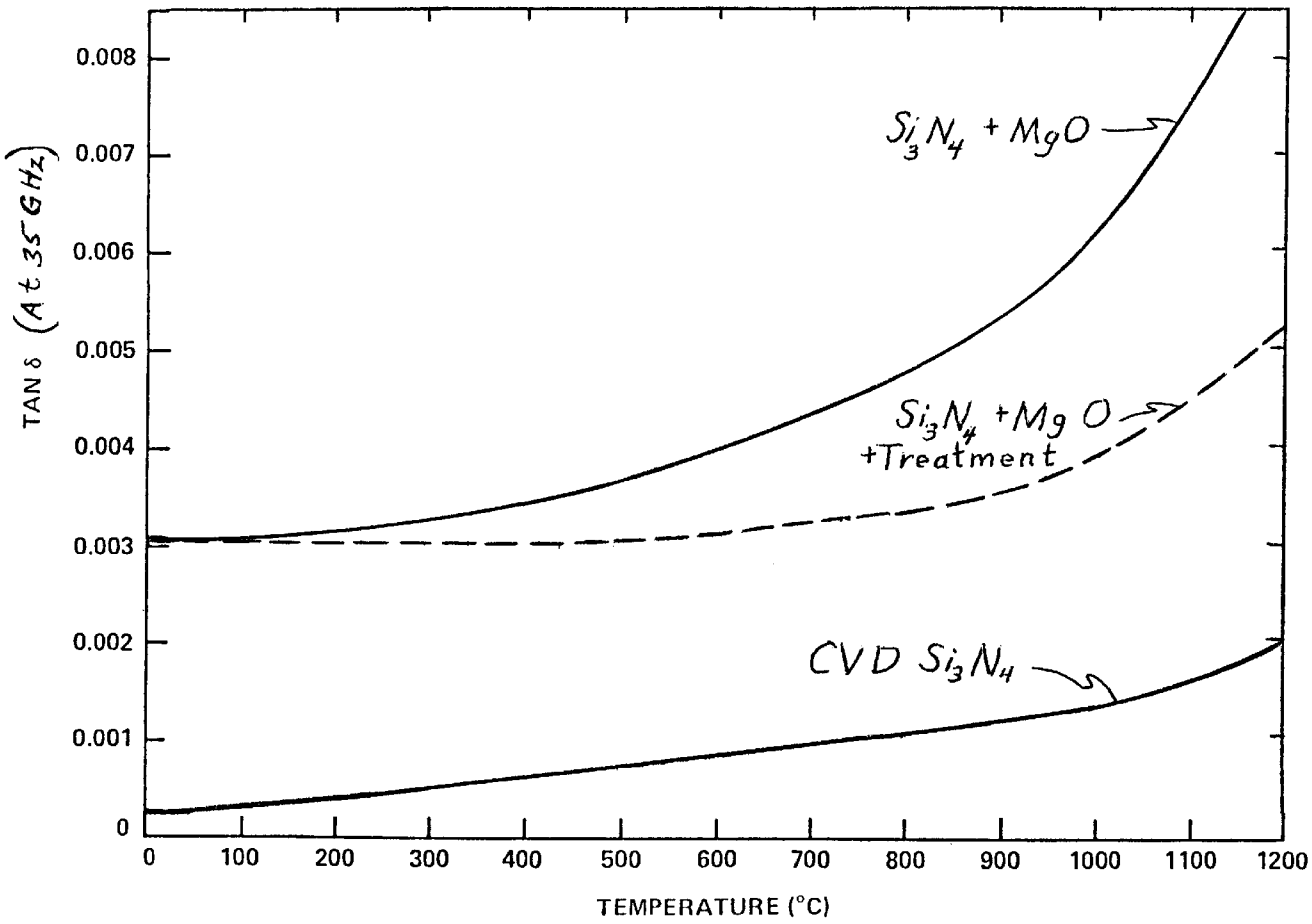
FIG. 1 is plot of the tangent loss of three $Si_3N_4$ materials at 35 GHz.

Pure $Si_3N_4$ has adequate dielectric constants at room temperature and at high temperatures. This is shown by the lower curve in FIG. 1 which is a plot of tangent loss vs temperature for polycrystalline chemical vapor deposited (CVD) $Si_3N_4$ CVD $Si_3N_4$ is substantially pure $Si_3N_4$ with no additives or densification aids added. However, when fabricated into components by standard ceramic production methods, the dielectric losses of $Si_3N_4$ components are substantially increased, particularly at high temperatures. This is shown by the upper curve in FIG. 1 which is a similar plot for hot-pressed $Si_3N_4$ having approximately 1 weight percent of MgO added as a densification aid. This is a commercially available ceramic identified as Norton Company's NC 132 material.

Commercial $Si_3N_4$ ceramics such as NC 132 have a primary phase of $Si_3N_4$ grains and a glassy secondary phase used to densify the alloy during the sintering operation. Densification aids which form the glassy secondary phase include MgO, $Y_2O_3$, CeO, $ZrO_2$ and $Al_2O_3$. The glassy phase is known from high resolution transmission electron microscopy to be a continuous intergranular phase which is approximately 10A thick and occupies only a few percent of the total volume fraction.

The glassy phase is primarily a silicate formed by the densification aid during the hot pressing or sintering of the $Si_3N_4$ ceramic powder. For example, in the case of ceramics which use MgO as a densification aid, the glassy phase has a eutectic composition (in mole fraction) of approximately 0.6 $Mg_2SiO_4$, 0.3 $Si_2N_2O$, and 0.1 $Si_3N_4$. However, it is not the existence of the $SiO_2$ in the glassy phase which causes the large loss in the dielectric constants of the sintered $Si_3N_4$ ceramic, because the dielectric constants of $SiO_2$ are known to be excellent.

As a result of experimental investigations, it was discovered that the dielectric losses exhibited by the sintered $Si_3N_4$ ceramics are attributable to impurities and additive cations in the intergranular glassy phase. In addition to the cations intentionally added by the densification aid ($Mg^{2+}$, $Y^{3+}$, $Ce^{2+}$, $Zr^{4+}$, or $Al^{3+}$), the glassy phase also contains small amounts of cation impurities such as $Ca^{2+}$, $Fe^{2+}$, $Al^{3+}$, $Mn^{2+}$, $Na^{1+}$, and $K^{1+}$.

In order to draw impurities out of the intergranular glassy phase and to improve the dielectric properties of the $Si_3N_4$ ceramic, it is covered with $SiO_2$ and heated at a high temperature. This treatment (described in U.S. patent application Ser. No. 266,244 filed May 22, 1981 by the present co-inventors) increases the high temperature strength of dense, polyphase silicon nitride ceramics. Cations in the glassy phase diffuse to the surface because of a reaction couple between the $SiO_2$ on the surface and the cation-containing glassy phase in the bulk of the material. This diffusion produces a compositional gradient within the ceramic.

The $SiO_2$ on the surface which forms one side of the diffusion couple and draws out the detrimental cations can be provided simply by heating the specimen in air or oxygen. This creates an $SiO_2$ scale as a result of the oxidation of the $Si_3N_4$. In a second embodiment of the invention, the $SiO_2$ is provided by surrounding the $Si_3N_4$ ceramic with $SiO_2$ powder during a high temperature heat treatment. Cations (other than Si) which form the glassy phase will diffuse to the $SiO_2$ on the surface in an attempt to reach equilibrium.

During the $SiO_2$ treatment, the $Si_3N_4$ ceramic must be heated to a temperature which is sufficient to cause diffusion of impurities and additive cations from the glassy phase into the $SiO_2$ on the surface. Diffusion is a temperature dependent phenomenon, the rate of diffusion being higher at higher temperatures. The optimum temperature and time for a particular additive and operating condition can be readily determined by emperical tests. For many conditions, temperatures in the range of approximately 1000° C. to 1700° C. for times less than approximately 300 hours can be used.

After the $SiO_2$ treatment the surface is ground to form a radome and also to remove any surface pits that may be formed, since they may limit or reduce the overall strength of the radome.

The process can be applied to dense, $Si_3N_4$ ceramic of various compositions provided that the ceramic has an intergranular glassy phase, as illustrated by the following examples.

EXAMPLE I $Si_3N_4$+1 w/o MgO

A commercially available, hot-pressed $Si_3N_4$ ceramic (The Norton Company's #NC 132) which contains approximately 1 weight percent MgO as a densification aid was investigated. Its microstructure consists of grains of $Si_3N_4$ and a continuous, non-crystalline (glassy) intergranular phase. The intergranular phase is a silica-based material containing Mg, N, and impurities of Ca, Al, Na and Fe.

The ceramic was treated according to the invention by heating it in air at 1500° C. in order to form $SiO_2$ on its surface by oxidation of the $Si_3N_4$ Heating at 1500° C. was continued for 200 hours in order to cause diffusion of impurities and additive cations from the glassy phase into the $SiO_2$ on the surface. The ceramic was taken from the furnace and its surface ground to remove the $SiO_2$. If the ceramic were going to be used for a radome or other radio-frequency window, its surface would be further ground to remove any pits which might have formed during the $SiO_2$ treatment and to shape it into the desired configuration.

A cavity perturbation method was used to measure the dielectric constant and loss tangent of the $SiO_2$ treated sample over the temperature range of 20° C. to 1200° C. Briefly, the sample was inserted through a hole centered on the broad dimensions of a microwave cavity. This location placed the sample parallel to a uniform maximum electric field within the cavity. The dielectric constant of the sample was then calculated from the observed shift in resonant frequency, and the loss tangent calculated from the change in the Q of the cavity.

The dashed curve ($Si_3N_4$+MgO+treatment) in FIG. 1 shows the tangent loss of the treated sample at temperatures up to 1200° C. For comparison, the tangent loss under the same conditions for the untreated ceramic is also shown (curve $Si_3N_4$+MgO). The treated ceramic had significantly lower tangent loss, particularly at high temperatures. Additionally, the rate of change in tangent loss over the temperature range was much less, thus providing greater performance capability for windows and radomes which must operate over a broad temperature range.

EXAMPLE II $Si_3N_4$+8 w/o $Y_2O_3$

A commercially available, hot-pressed $Si_3N_4$ ceramic (The Ceradyne Corporation's #147Y-3065) which contains approximately 8 weight percent $Y_2O_3$ as a densification aid also has a glassy intergranular phase. When this ceramic is packed in $SiO_2$ powder or heated in air to provide $SiO_2$ on its surface and then held for 200 hours at 1500° C., its tangent loss at 35 GHz is reduced in a similar manner to that shown in FIG. 1 for Example I. The surface of the treated ceramic is ground or machined to remove surface pits and to form it into a radome with excellent high temperature strength and good high temperature dielectric properties.

EXAMPLE III $Si_3N_4$+8 m/o $Sc_2O_3$ $Si_3N_4$ ceramic powder was mixed with 8 mole percent $Sc_2O_3$ densification aid and then hot press sintered using conventional powder techniques to form a dense $Si_3N_4$ ceramic having a Sc-containing, intergranular glassy phase. The dense ceramic was then heated at 1500° C. for 200 hours and tested as described for Example I. Its dielectric properties were improved similarly as shown in FIG. 1 for the $Si_3N_4$+MgO ceramic.

EXAMPLE IV $Si_3N_4$+8 w/o $Y_2O_3$

A dense ceramic can be made using conventional hot-pressing techniques from a mixture of $Si_3N_4$ powder and 8 weight percent $Y_2O_3$. The loss tangent of this ceramic can be reduced by oxidizing its surface in an air furnace at 1600° C. Holding the ceramic at this temperature for 120 hours will cause cations in its glassy intergranular phase to diffuse out of the ceramic and into the $SiO_2$ on its surface. The treated ceramic can then be machined to remove pits and to shape it into a radome.

EXAMPLE V $Si_3N_4$+15 w/o $Y_2O_3$+10 w/o $SiO_2$

A dense ceramic was made by injection molding and sintering techniques from a mixture of $Si_3N_4$ powder 15 weight percent $Y_2O_3$ and 10 weight percent $SiO_2$. The dense ceramic formed had a Y-containing intergranular glassy phase. Heating the ceramic in a $SiO_2$ powder bed in air at 1500° C. for 200 hours resulted in cations diffusing to the surface from the glassy intergranular phase. The surface of the sample was machined to remove the scale. If it were going to be used for a radome, it would have been further machined to remove all pits and shape it into a radome. Measurements taken before and after the above treatment showed that the treatment reduced the sample's loss tangents.

As the above examples illustrate, a high temperature $SiO_2$ treatment can be used to improve the dielectric properties of sintered $Si_3N_4$ ceramics. This makes $Si_3N_4$ more attractive for use in applications which require good high temperature strength and improved dielectric properties.

Numerous variations and modifications can be made without departing from the invention. For example, $Si_3N_4$ ceramics having a wide variety and amount of additives and glassy phase densification aids can be processed according to the invention. The term "sintering" is used in this patent to include any suitable technique for consolidating the ceramic powders such as: pressing and sintering, hot pressing, and hot isostatic pressing (HIPPING). Therefore, it should be clearly understood that the form of the invention described above is illustrative only and is not intended to limit the scope of the invention.

What is claimed is:

1. A method of fabricating a ceramic window for a radio-frequency device, comprising the steps of:

providing a dense, sintered $Si_3N_4$ ceramic having a glassy phase;

providing $SiO_2$ on the surface of said $Si_3N_4$ ceramic;

heating said $Si_3N_4$ ceramic and said $SiO_2$ at a temperature sufficient to cause diffusion of impurity and additive cations from said glassy phase into said $SiO_2$;

removing said $SiO_2$ and the underlying surface of said $Si_3N_4$ ceramic to a depth sufficient to remove surface pits; and shaping said $Si_3N_4$ ceramic into a window for a radio-frequency device.

2. The method as claimed in claim 1 wherein said window is a radome.

3. The method as claimed in claim 1, wherein said steps of removing and of shaping comprise grinding the surface of said $Si_3N_4$ ceramic.

4. The method as claimed in claim 1, wherein said step of providing $SiO_2$ comprises packing said $Si_3N_4$ ceramic in $SiO_2$ powder.

5. The method as claimed in claim 1, wherein said step of providing $SiO_2$ comprises heating said $Si_3N_4$ ceramic in an oxidizing atmosphere, whereby an $SiO_2$ scale is formed on said $Si_3N_4$ ceramic by oxidation of said $Si_3N_4$ ceramic.

6. A method of fabricating a ceramic radome, comprising the steps of:

providing a mixture of $Si_3N_4$ powder and a densification aid to cause densification due to the formation of a liquid glassy phase during sintering;

sintering said mixture to form a dense $Si_3N_4$ ceramic;

providing silicon dioxide on the surface of said $Si_3N_4$ ceramic;

heating said $Si_3N_4$ ceramic and said silicon dioxide at a temperature sufficient to cause diffusion of impurities and additive cations from said glassy phase into said $SiO_2$;

removing said silicon dioxide and the underlying $Si_3N_4$ surface from said $Si_3N_4$ ceramic to a depth sufficient to remove surface pits; and shaping said $Si_3N_4$ ceramic into a radome configuration.

7. The method as claimed in claim 6, wherein said densification aid comprises MgO.

8. The method as claimed in claim 6, wherein said densification aid comprises CeO.

9. The method as claimed in claim 6, wherein said densification aid comprises $Y_2O_3$.

10. The method as claimed in claim 6, wherein said densification aid comprises $Sc_2O_3$.

11. The method as claimed in claims 7, 9, and 10, wherein said step of heating comprises heating said $Si_3N_4$ ceramic and said $SiO_2$ at a temperature of approximately 1500° C. for approximately 200 hours.

12. The method as claimed in claim 9, wherein said step of heating comprises heating said $Si_3N_4$ ceramic and said $SiO_2$ at a temperature of approximately 1600° C. for approximately 120 hours.

* * * * *